US008006842B1

(12) United States Patent
Loughlin, Jr. et al.

(10) Patent No.: US 8,006,842 B1
(45) Date of Patent: Aug. 30, 2011

(54) PACKAGING FOR AUTHENTICATION TOKENS

(75) Inventors: William F. Loughlin, Jr., Lowell, MA (US); Stephen Elbeery, Hampton Falls, NH (US)

(73) Assignee: EMC Corporation, Hopkinton, MA (US)

( * ) Notice: Subject to any disclaimer, the term of this patent is extended or adjusted under 35 U.S.C. 154(b) by 224 days.

(21) Appl. No.: 12/336,381

(22) Filed: Dec. 16, 2008

(51) Int. Cl.
*B65D 85/48* (2006.01)

(52) U.S. Cl. ..... 206/449; 206/485; 206/509; 220/553

(58) Field of Classification Search ..... 206/449, 206/454, 455, 485, 387.15, 425, 526, 564, 206/707, 711, 722, 723, 509, 511; 220/507, 220/528, 553, 555
See application file for complete search history.

(56) References Cited

U.S. PATENT DOCUMENTS

| | | | | |
|---|---|---|---|---|
| 5,441,150 | A * | 8/1995 | Ma | 206/707 |
| D381,344 | S | 7/1997 | Kosaku | |
| 5,857,573 | A * | 1/1999 | Pakeriasamy | 206/723 |
| 5,873,472 | A | 2/1999 | Weisburn | |
| 5,934,463 | A | 8/1999 | Yu | |
| D425,703 | S | 5/2000 | Ohayon | |
| 6,062,388 | A | 5/2000 | Ohayon | |
| D443,790 | S | 6/2001 | Bennett | |
| 6,296,122 | B1 * | 10/2001 | Nakazono et al. | 206/511 |
| 6,340,086 | B1 | 1/2002 | McConnaughy et al. | |
| 6,427,842 | B1 * | 8/2002 | Green | 206/526 |
| D493,659 | S | 8/2004 | Ohayon | |
| D509,982 | S | 9/2005 | Yang | |
| 7,228,974 | B2 | 6/2007 | Ohayon | |
| 2003/0226781 | A1 * | 12/2003 | Liao | 206/454 |
| 2005/0006266 | A1 * | 1/2005 | Kurikawa | 206/455 |
| 2008/0156690 | A1 * | 7/2008 | Landau et al. | 206/723 |

* cited by examiner

*Primary Examiner* — Luan K Bui
(74) *Attorney, Agent, or Firm* — BainwoodHuang

(57) ABSTRACT

Packaging for authentication tokens is disclosed that supports individual card-shaped tokens. The packaging supports multiple cards in a single tray that separates the cards from each other, protects the buttons of the cards from inadvertent activation, and protects the display window from damage. The packaging includes a tray having a base, walls extending from the base, a plurality of engagement members for holding each card, and a cover. The walls include a pair of sidewalls and at least one interior wall, each sidewall having an inner surface with a plurality of slots and the interior wall having an outer surface with a plurality of slots. The slots in the sidewalls correspond in number and location to the slots in the interior wall, the paired slots together forming a card engagement member.

23 Claims, 18 Drawing Sheets

PACKAGING FOR AUTHENTICATION TOKENS

BACKGROUND

In general, a conventional authentication token is a device that creates one-time passcodes (OTPs) for use in authenticating a user to an authentication entity. To this end, the user activates the authentication token, e.g., by pressing a button. The authentication token then derives an OTP from a seed (or encryption key) and outputs the OTP, e.g., by displaying the OTP on a display to the user.

During a typical authentication session such as when the user wishes to obtain access to a resource (e.g., the user wishes to login to a website), the user provides the user-derived OTP to the authentication entity. The authentication entity compares the user-derived OTP with an independently-derived OTP for that user. If the user-derived OTP and the independently-derived OTP match, the user has successfully authenticated with the authentication entity and the authentication entity grants the user access to the resource. However, if the user-derived OTP and the independently-derived OTP do not match, authentication is unsuccessful and the authentication entity denies the user access to the resource.

Authentication tokens are available in a variety of different shapes and/or sizes. For example, some authentication tokens take the form of a keychain attachment. Other authentication tokens are credit-card shaped with a correspondingly thin profile. Yet other authentication tokens take the form of a small calculator. Devices, which are similar to those described above, and which have a generally rectangular body extending from a rounded end are disclosed in U.S. Design patents D517,440, D516,929 and D511,983 which are assigned to RSA Security Inc. of Bedford, Mass.

SUMMARY

The size of the tokens along with the embedded technology and limited number of codes makes it desirable to protect the tokens from unintentional damage and OTP activation. If the tokens become damaged, the embedded electronics may not work properly. Additionally, if the button on a token is accidentally depressed, the OTP sequence may become out of sync with the authentication entity rendering the card ineffective. Depressing the button can also decrease the battery life of the device.

In order to maintain the tokens in good working order, and to avoid the unintentional activation of the button that can trigger a change in the OTP, packaging is provided that isolates individual tokens while also avoiding contact with the activation button. The packaging allows for multiple tokens to be packaged in a single tray separated from each other, and protects the activation buttons as well as the display window. The packaging includes a tray having a base, walls extending from the base, a plurality of engagement members for holding each token, and a cover.

In one embodiment, the walls include a pair of sidewalls and at least one interior wall sized to receive a token having a generally credit-card shape and size, each sidewall having a plurality of slots disposed on an inner surface thereof and the interior wall having a plurality of slots disposed on an outer surface thereof. The slots in the sidewalls correspond in number and location to the slots in the interior wall, the paired slots together forming a card engagement member. The slots are sufficiently spaced from each other so that the cards do not touch adjacent cards when held by the slots. Additionally, slots have a depth that is sized to hold the edge bordering the cards within the slots while avoiding contact with button in order to protect the button from inadvertently being activated during storage and/or transportation.

In one embodiment, the length of the slots and the depth of the tray may be sized to seat the cards within the tray with a top edge of the cards being flush with or below the top surface of the tray. In another embodiment, the top edge of the card extends from the top surface of the tray. A cover may be provided for any of the embodiments, the cover being placed over the top of the cards and tray. In one embodiment, the cover may be secured to the tray, for example by a locking tab. Additionally, the trays may be stackable so that the stacked trays act as a cover to trays that are disposed beneath and a cover is provided on the uppermost tray.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Figure 1:
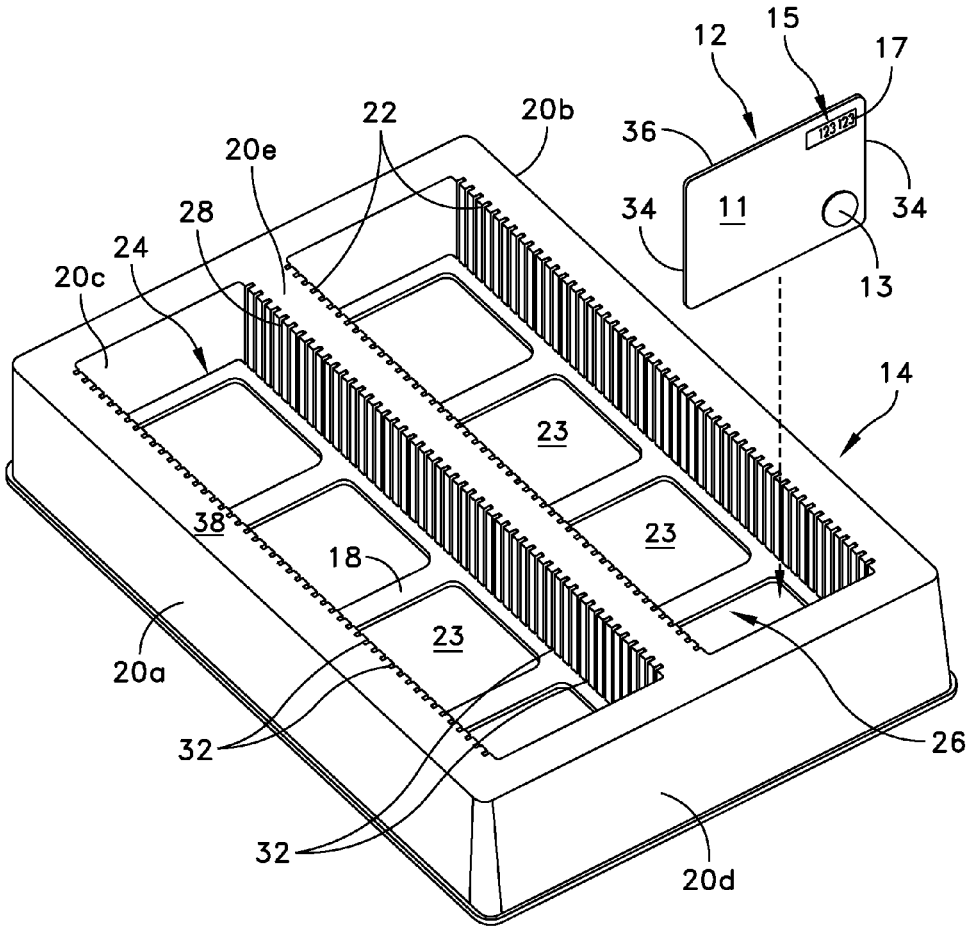
FIG. 1 is perspective view of a first embodiment of a packaging device tray for transporting authentication tokens.
Figure 2:
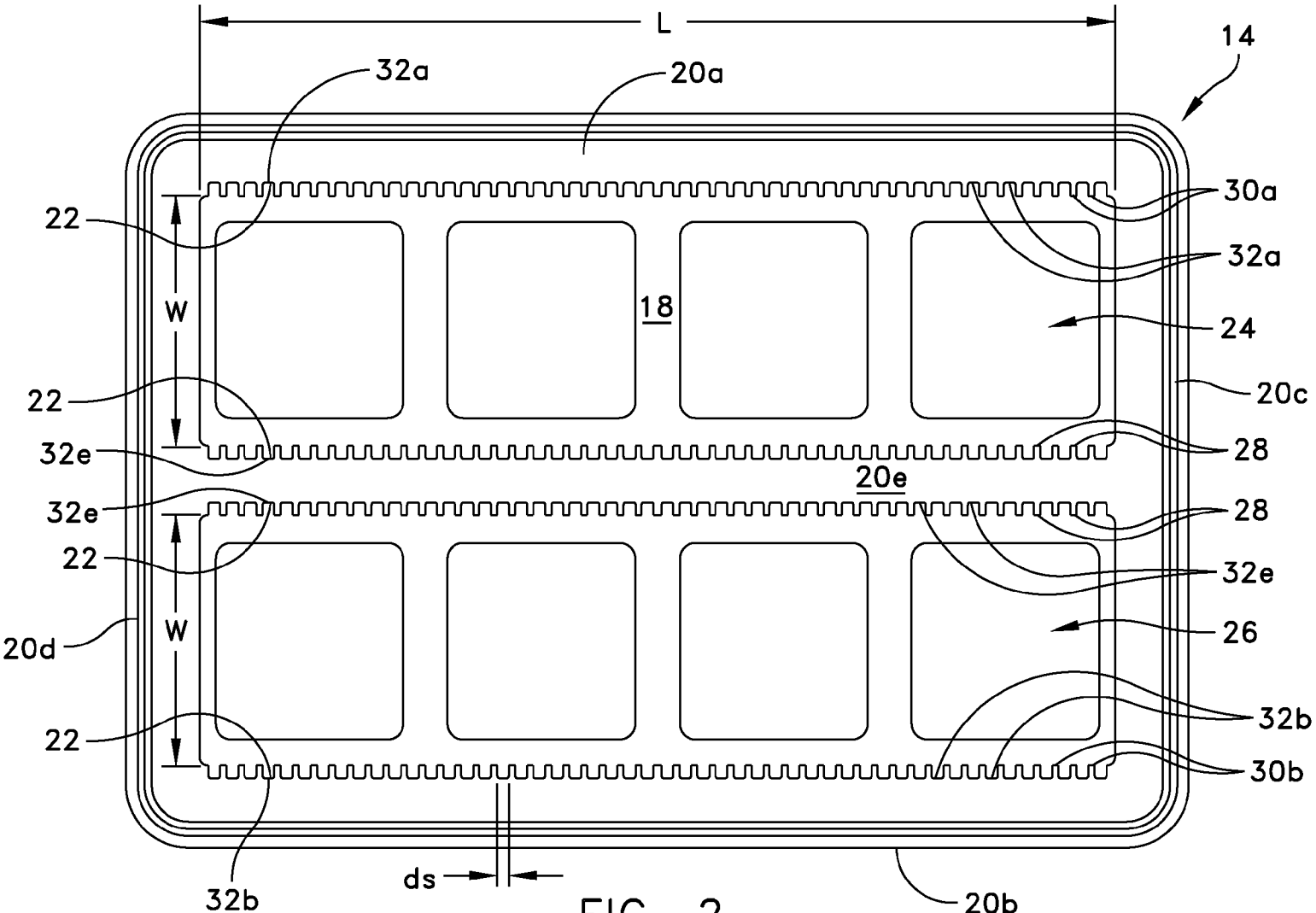
FIG. 2 is a top plan view of the embodiment of FIG. 1.
Figure 3A:
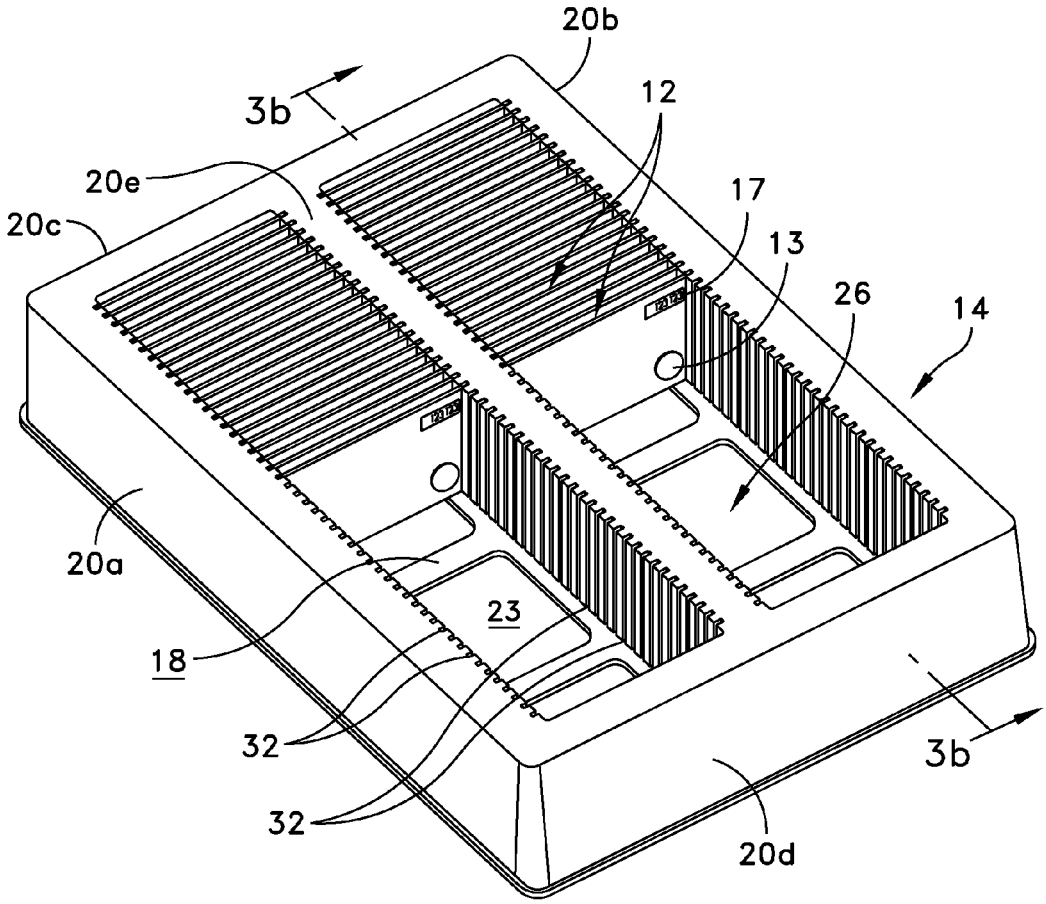
FIG. 3*a* is a perspective view of the tray of FIG. 1 with a plurality of authentication tokens supported in the device.
Figure 3B:
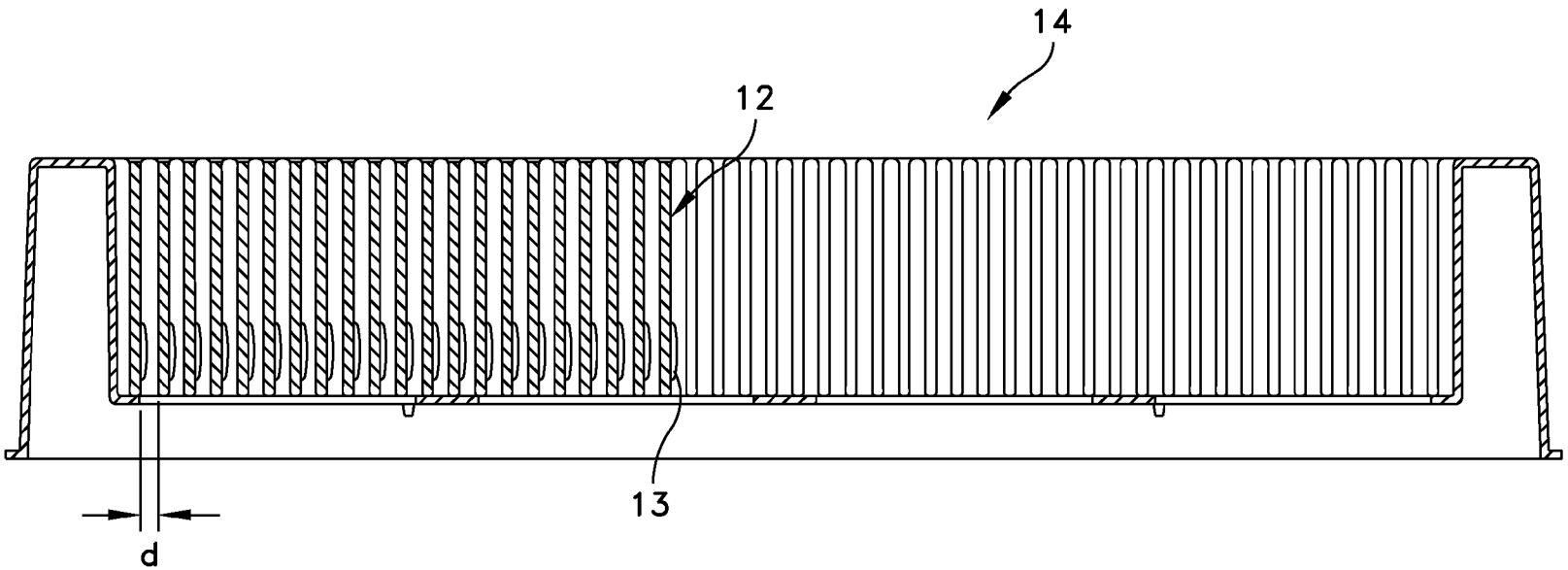
FIG. 3*b* is a cross-sectional view of the tray taken along line 3*b*-3*b* of FIG. 3*a;*
Figure 4:
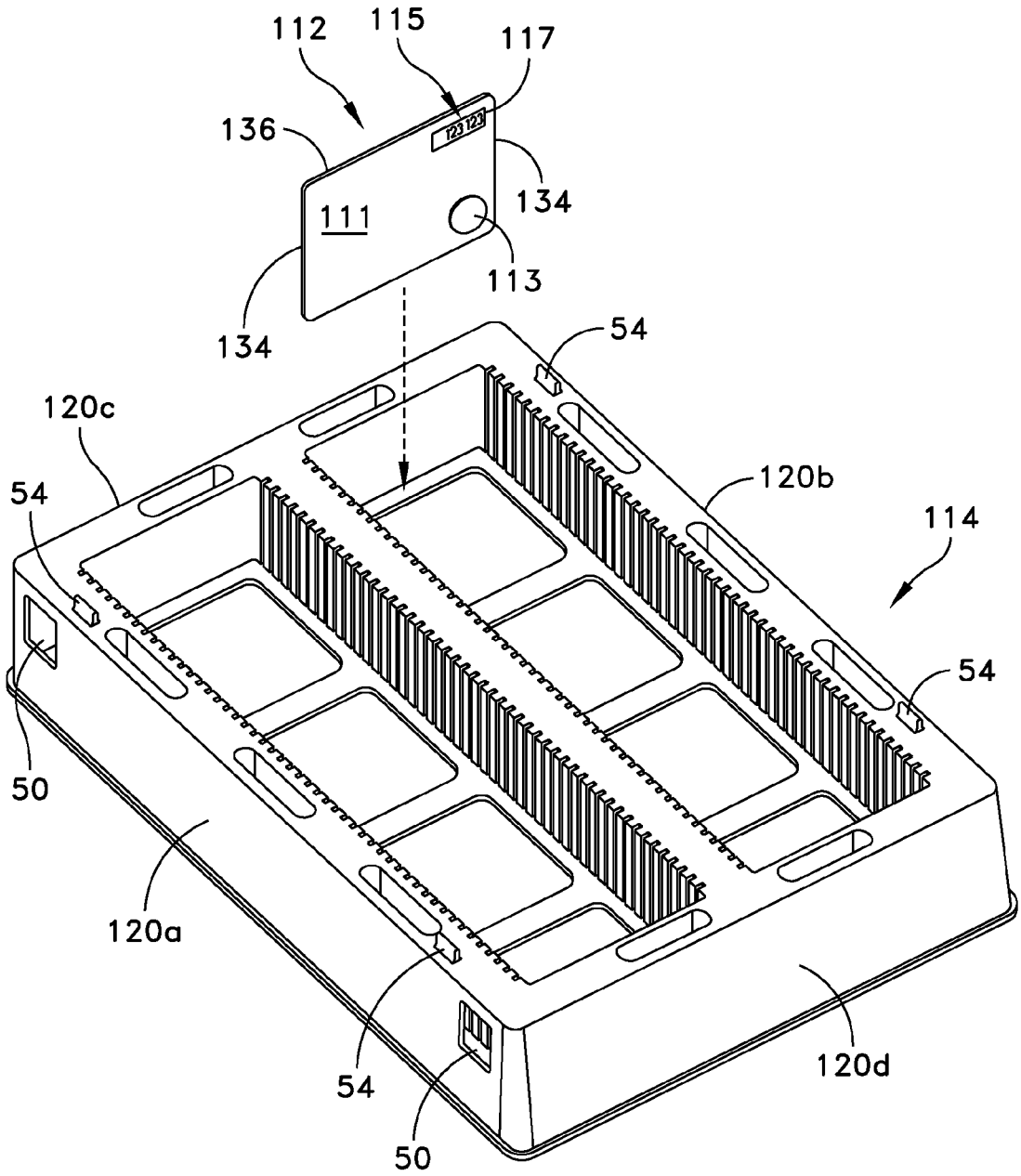
FIG. 4 is perspective view of a second embodiment of a packaging device tray for transporting authentication tokens.

Referring initially to FIGS. 1-3, a first embodiment of a packaging device 10 for transporting multiple authentication style tokens is illustrated. The device 10 includes a tray 14 for housing authentication tokens or cards 12, and multiple engagement members 22 for supporting the cards within the tray. A cover 16 for securing the cards 12 within the tray may also be provided, as described below with respect to the second embodiment.

The cards as described herein are authentication style tokens that generally have the shape and size of a conventional credit card, for example 86 mm×55 mm×1 mm (L×W×D) in the present embodiment. The cards each include a face 11 with an activation portion, for example button 13, and display window 15 disposed on the face 11. As is known in the art, a user depresses the button 13 in order to receive a one-time passcode (OTP) 17 which is displayed in window 15 in a prescribed order, as described herein above. It should be understood that card 12 is an exemplary authentication token and although the description that follows is with respect to a generally rectangular, credit card shaped and sized token, the dimensions, shape and size of the token may be varied, as would be known to those of skill in the art. Likewise, although authentication tokens are described herein, the invention may also be used to house other types of cards, tokens, or similar items, for example smart cards, door access cards, other interactive devices, and the like, where it is desirable to support the device in some areas without contacting other areas. In addition, although the cards 12 disclosed herein include a button 13 disposed on the face 11 of the card that is activated by a user to produce an OTP that is visible in window 15, other elements may be included on the card that are not illustrated herein. For these elements it may also be desirable to support the cards during storage and in transport in a manner to avoid contact with the elements, as described in greater detail below with respect to the button and display window.

Figure 11:
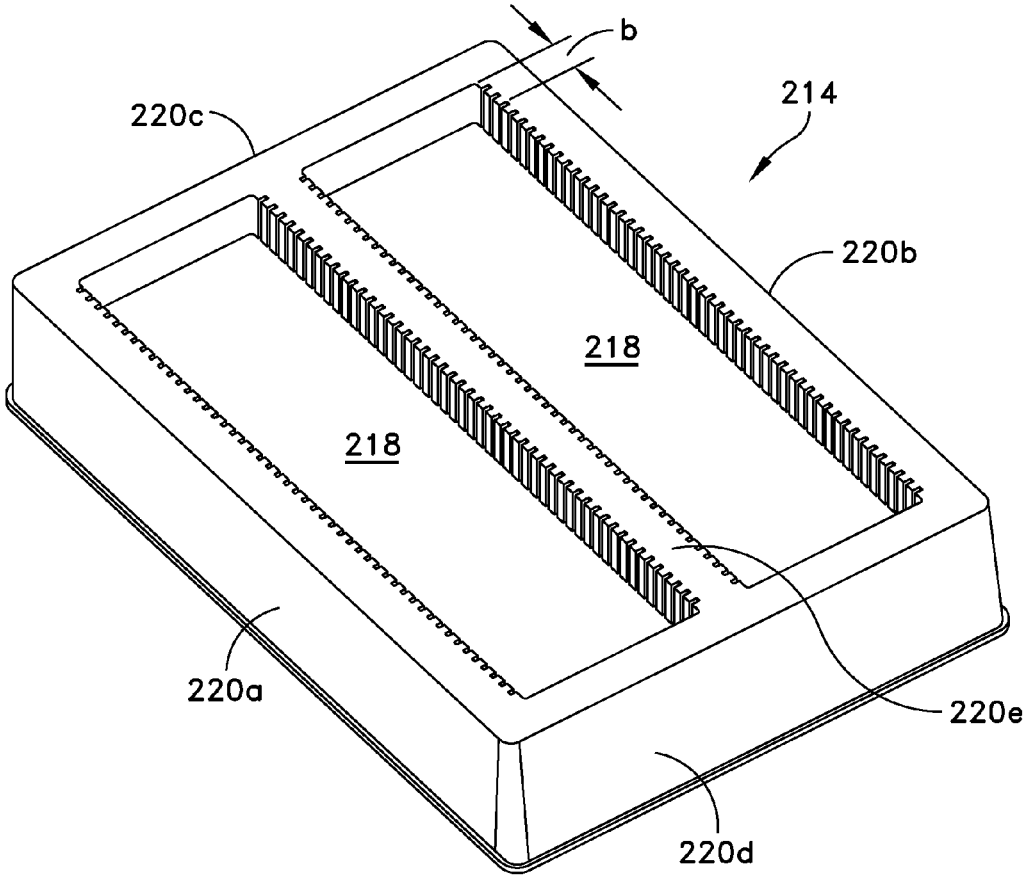
FIG. 11 is a perspective view of a third embodiment of a packaging device tray for authentication tokens.
Figure 12:
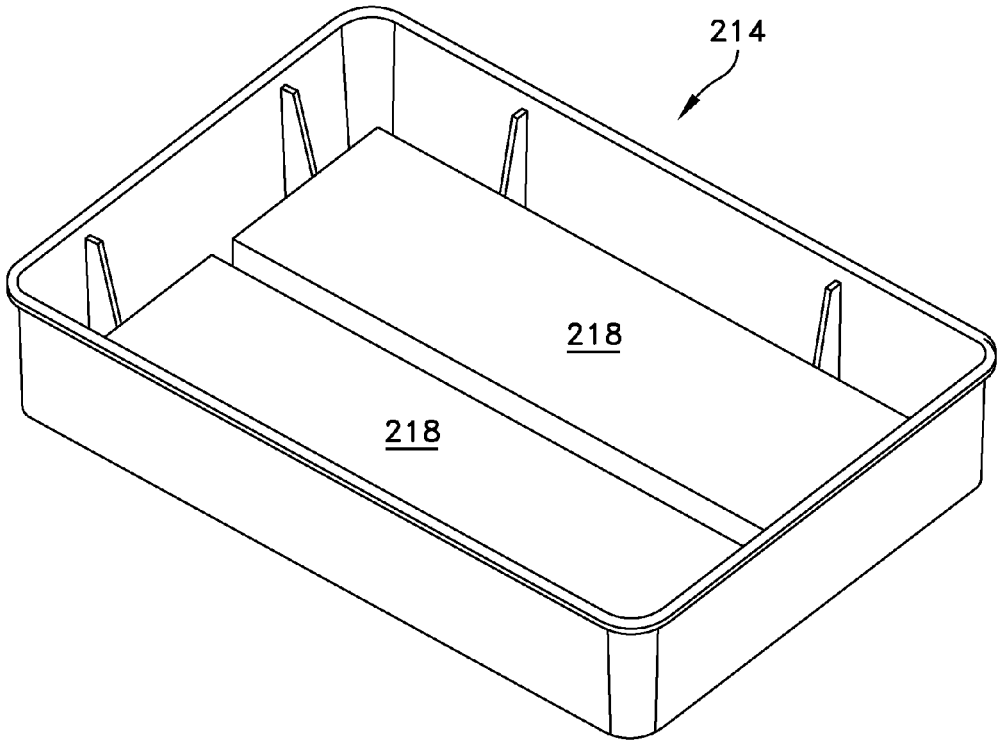
FIG. 12 is a bottom perspective view of the device of FIG. 11.
Figure 17:
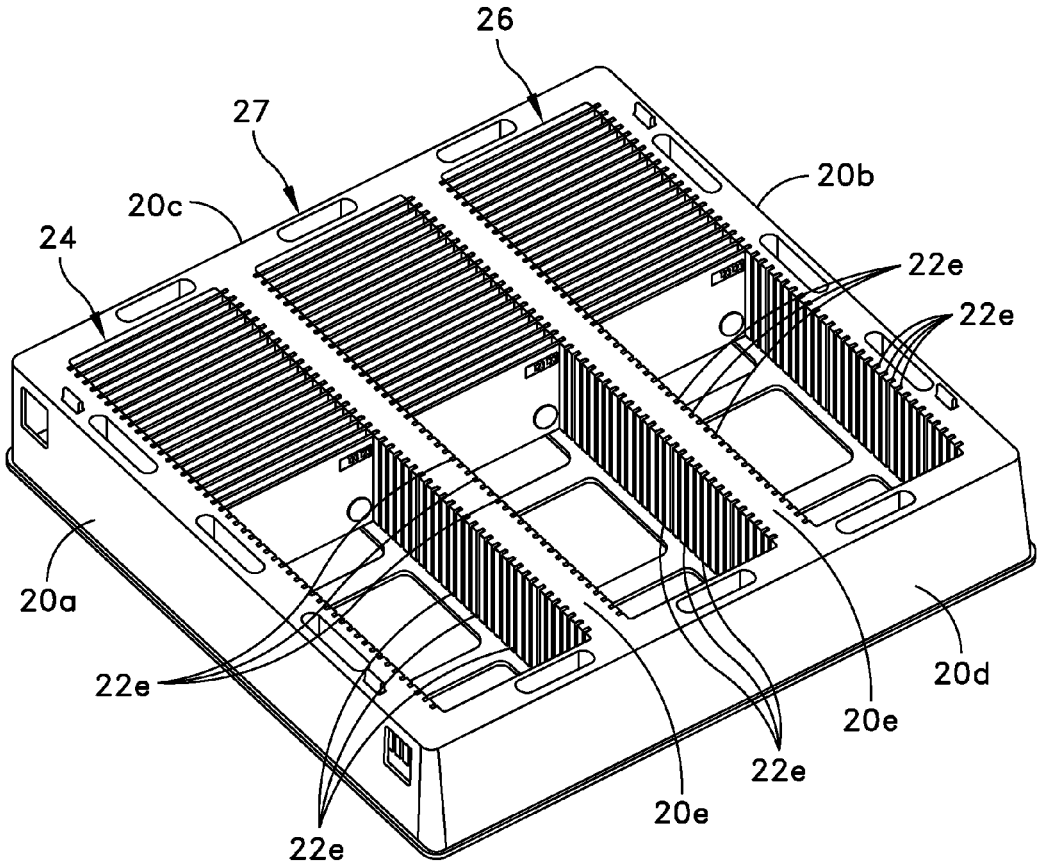
FIG. 17 is a perspective view of a fourth embodiment of the packaging device tray.
Figure 18:
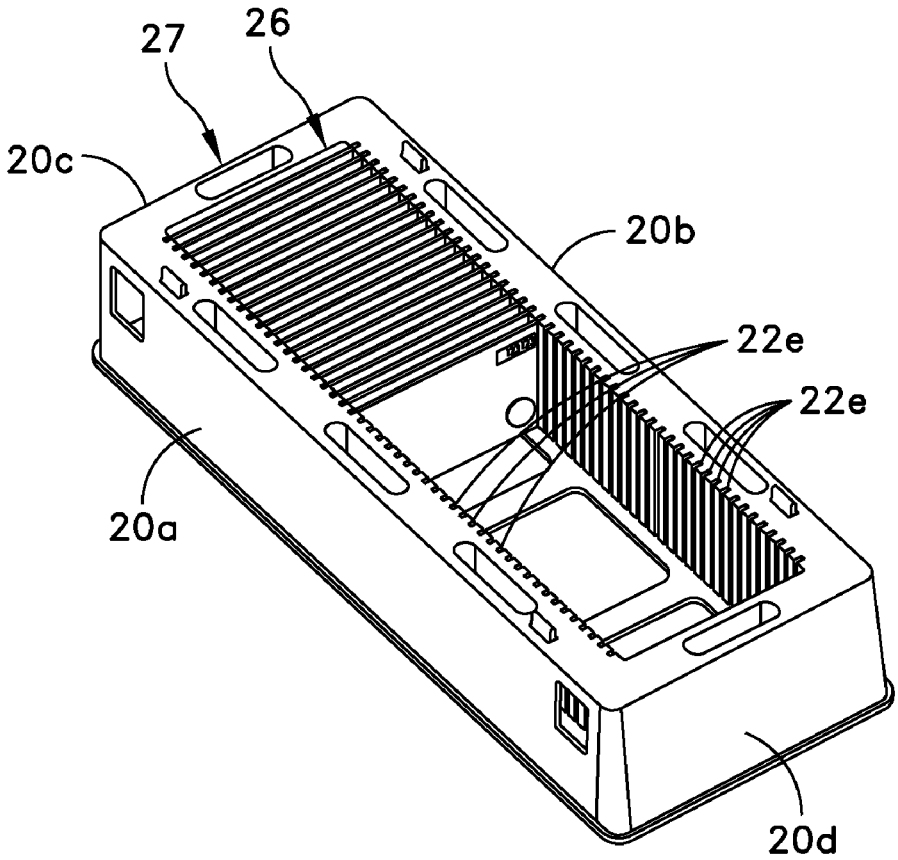
FIG. 18 is a perspective view of a fifth embodiment of the packaging device tray.

In the present embodiment, the tray 14 includes a base 18, a set of walls 20*a*-20*e* extending from the base, and a plurality of engagement members 22 for holding each card 12 in place. The tray may be molded of a thermoplastic material, for example PET (polyethylene terephthalate), or may be formed from any other material that is both lightweight and provides structural support so that the tray maintains its shape during shipping. The base may include openings 23 there through in order to decrease the amount of material and, therefore, weight of the tray, as illustrated in the present embodiment. Alternately, the base of the tray may have a continuous surface as illustrated in FIG. 11, and as described in greater detail below. In either case, a pair of sidewalls 20*a*, 20*b* and a pair of end walls 20*c*, 20*d* extends from base 18, the sidewalls and the end walls together defining a perimeter of the tray. The tray may further include one or more interior walls 20*e*, so as to divide the tray into one or more columns or channels 24, 26 for housing additional cards 12. In order to increase the number of cards that a tray can support, the length of the channels may be increased, or the number of channels may be increased by including additional interior walls 20*e*, for example as shown in FIG. 17, depending upon the desired size of the tray and the amount of cards to support. Likewise, no interior wall may be provided so that only a single column or channel is present as illustrated in FIG. 18. The overall length, "L" of the channels may be in the range of about 180 mm to about 300 mm, and is about 300 mm in the present embodiment, while the width "W" of each channel disposed between the outer surfaces 28 of the interior wall 29*e* and the adjacent inner surfaces 30*a*, 30*b* of the sidewalls 20*a*, 20*b* in the range of about 80 mm to about 85 mm, and is about 80 mm in the present embodiment.

Figure 6:
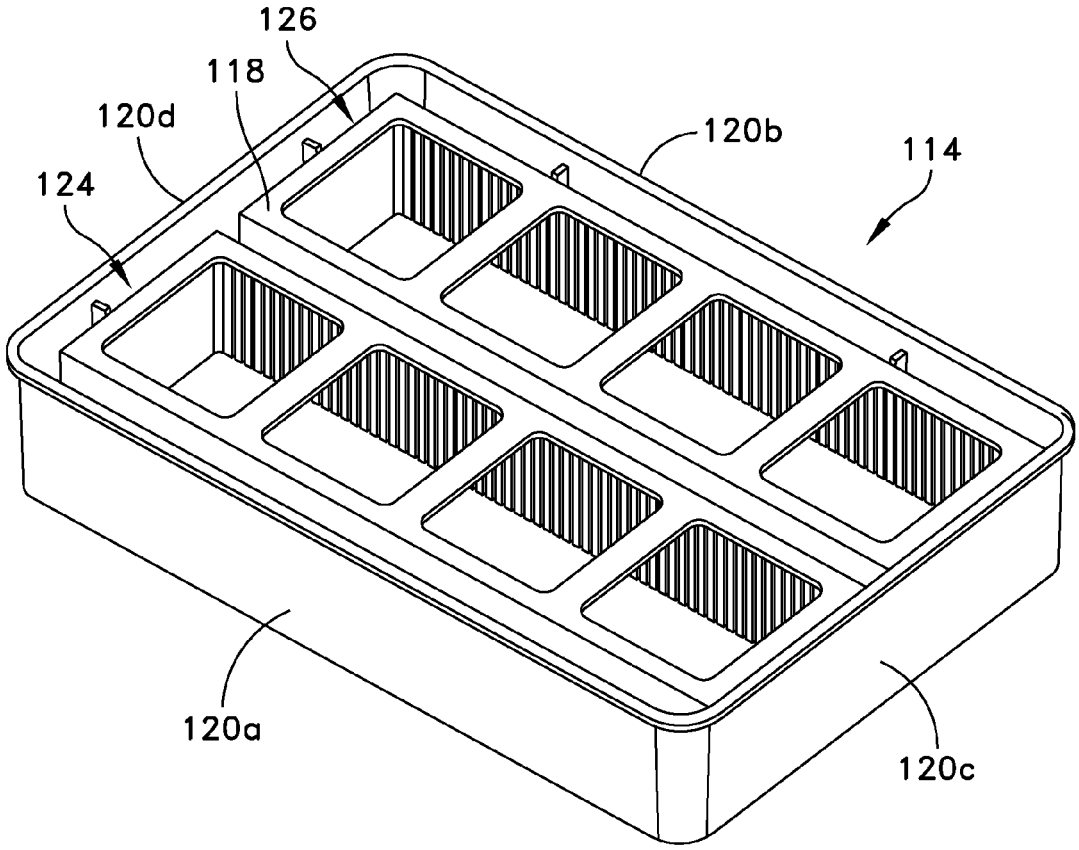
FIG. 6 is a bottom perspective view of the tray of FIG. 4.

As best illustrated in FIG. 2, the outer surfaces 28 of the interior wall 20*e* and the inner surfaces 30*a*, 30*b* of the sidewalls 20*a*, 20*b* each include a plurality of slots 32 disposed therein. The slots 32*e* in the interior wall 20*e* correspond in number and location to the slots 32*a*, 32*b* on the sidewalls 20*a*, 20*b* facing the interior wall 20*e*, respectively. The paired slots 32*a*, 32*e* and 32*b*, 32*e* on the interior wall and corresponding sidewalls together form a card engagement member 22. As will be appreciated, in the embodiment of FIG. 17, the additional channel 27 is bounded on either side by slots 22*e*, each of the slots on both sides of the channel being formed in an interior wall 20*e*, and not in a sidewall. Any number of slots may be provided, depending upon the size of the tray and spacing between the cards. To protect the cards from damage, the slots may preferably be spaced so that the cards are separated from each other within the slots as illustrated in FIG. 6. In this position, the faces 11 of the cards are spaced a distance, "d" from each other, so that the cards are not touching, which can cause rubbing and possible damage to the cards. In the present embodiment, the distance "d" is about 2.95 mm with a range of about +/−0.20 mm.

Figure 5:
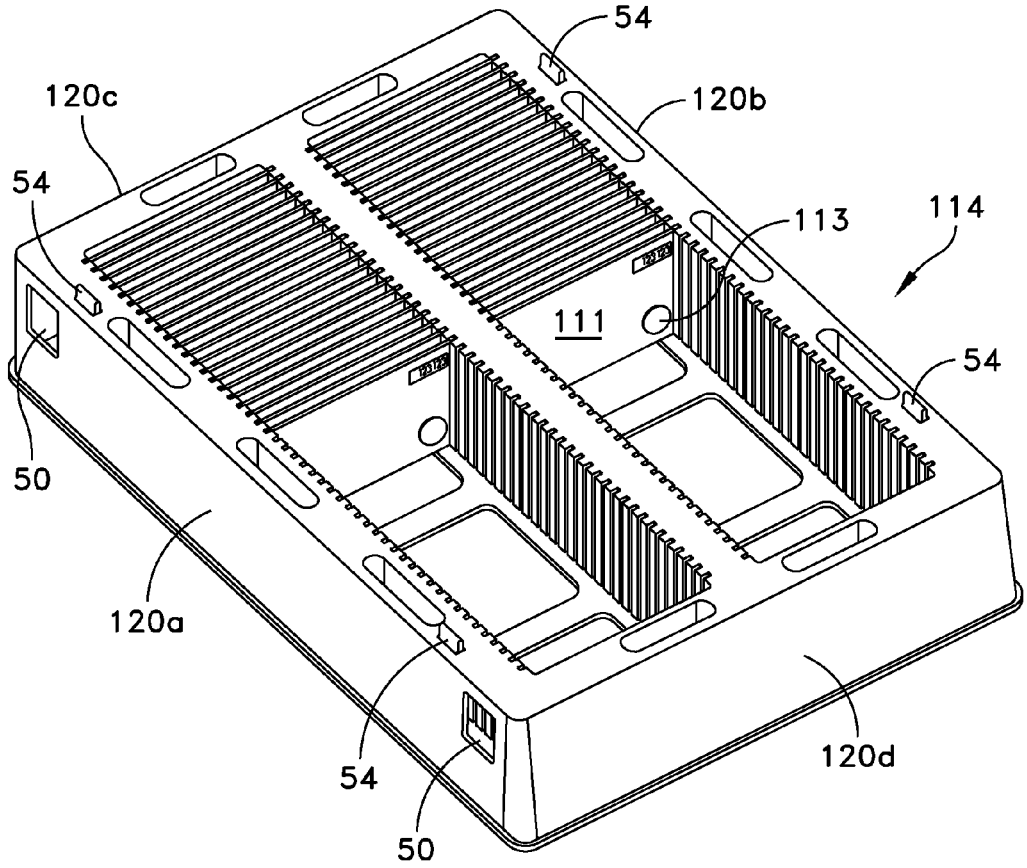
FIG. 5 is a perspective view of the tray of FIG. 4 with a plurality of authentication tokens supported in the device.

The slots 32 have a depth that is sized to hold the cards 12 within the slots 32 while avoiding contact with button 13 in order to protect the button from inadvertently being activated during storage and transportation, which could result in the OTP sequence becoming out of sync, as described above. The location of the button 13 on the face 11 of the card 12 determines the maximum depth of the slots since the slots are designed to retain the cards with the button exterior to the slots, i.e. the buttons are positioned within channels 24, 26, as illustrated in FIG. 5. The maximum depth of the slots may be determined by an outer border of the card 12. The outer border as described herein is not a physical border on the card, but rather the distance between the perimeter of the button 13 and the edge 34 of the card 12. Therefore, the dimensions of the border will vary according to the placement of the button on the card and, likewise, the depth of the slots may also be varied depending upon the size of the border. In this manner, when the edges 34 of the card are inserted within slots 32, the outer border, but not the button of the card, is received within the slots 32. In the present embodiment, the outer border on the card may be between about 3-5 mm.

Figure 14:
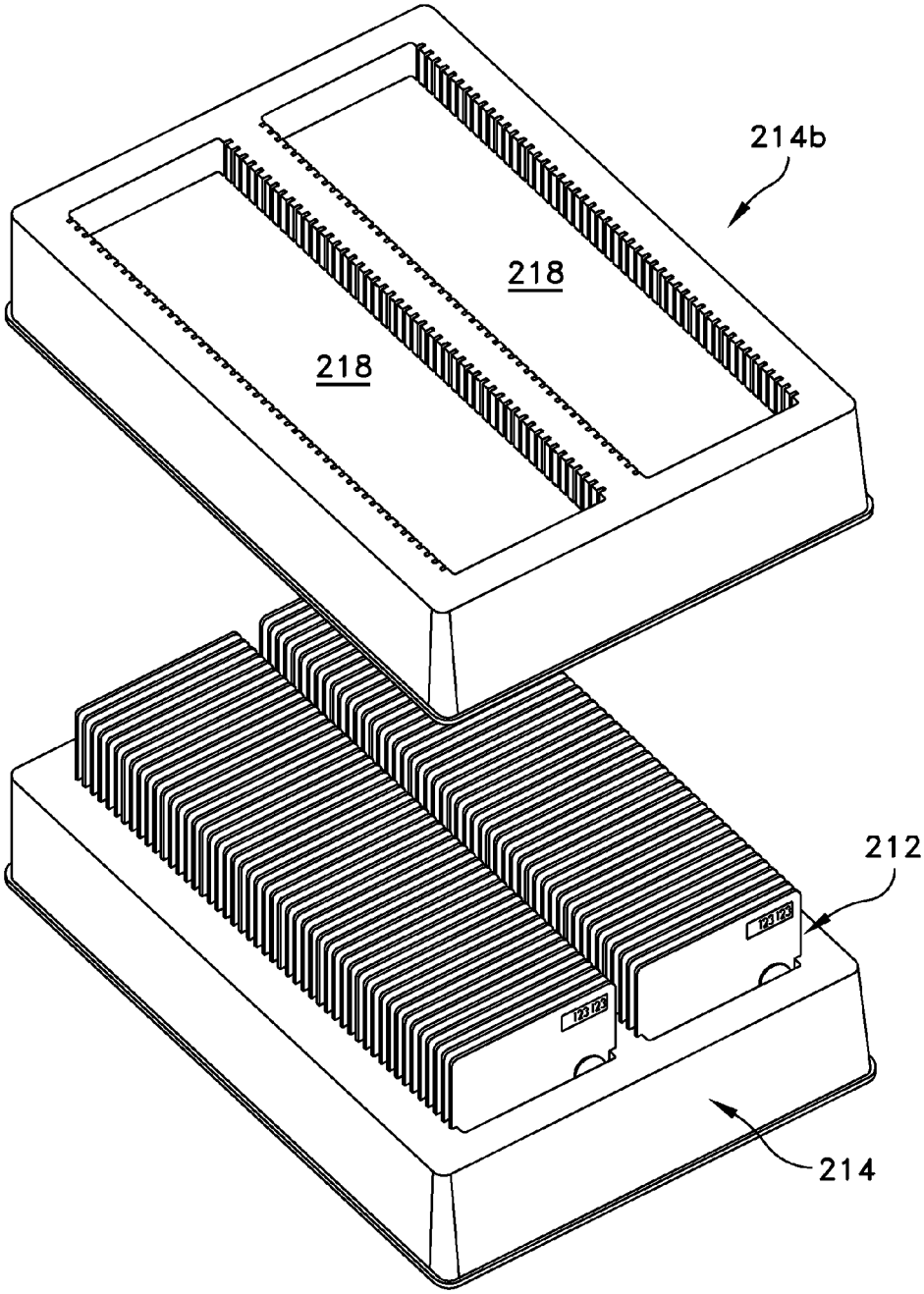
FIG. 14 is a perspective view of an empty tray prior to being stacked onto the full tray of FIG. 11.

The length of the slots and the depth of the tray may be sized to seat the cards within the tray with the top edge 36 of the cards being flush with or below the top surface 38 of the tray, as illustrated in the present embodiment. If the cards are positioned within the tray in this manner, the display window 15 may also be supported within the channels 24, 26 and are preferably not in contact with the slots 32 so as to protect the display windows from becoming scratched or otherwise damage. In the present embodiment, the depth "ds" of the slots is about 55 mm, but may be as deep as 60 mm. Alternatively, the length of the slots may be sized so that the upper portion of the card 12 adjacent and including the display window 15 extends above the top surface 32 of the tray 14, as illustrated in FIG. 14. In either case, cover 16 or an additional stacked tray 14*b* may be placed over the top of tray 14 in order to help retain the cards within the tray.

Figure 7:
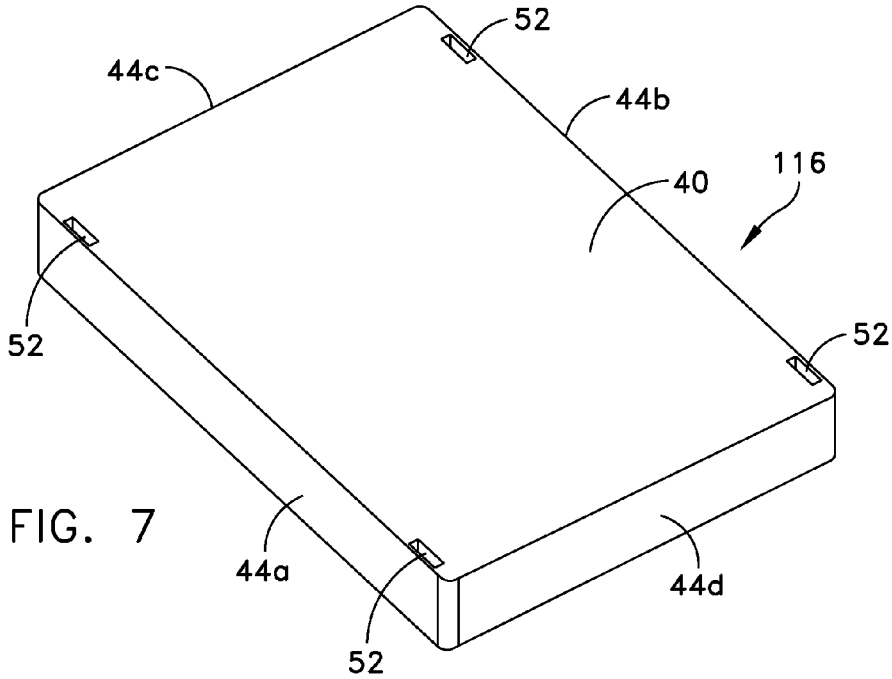
FIG. 7 is a top perspective view of a cover of the device of FIG. 4.
Figure 8:
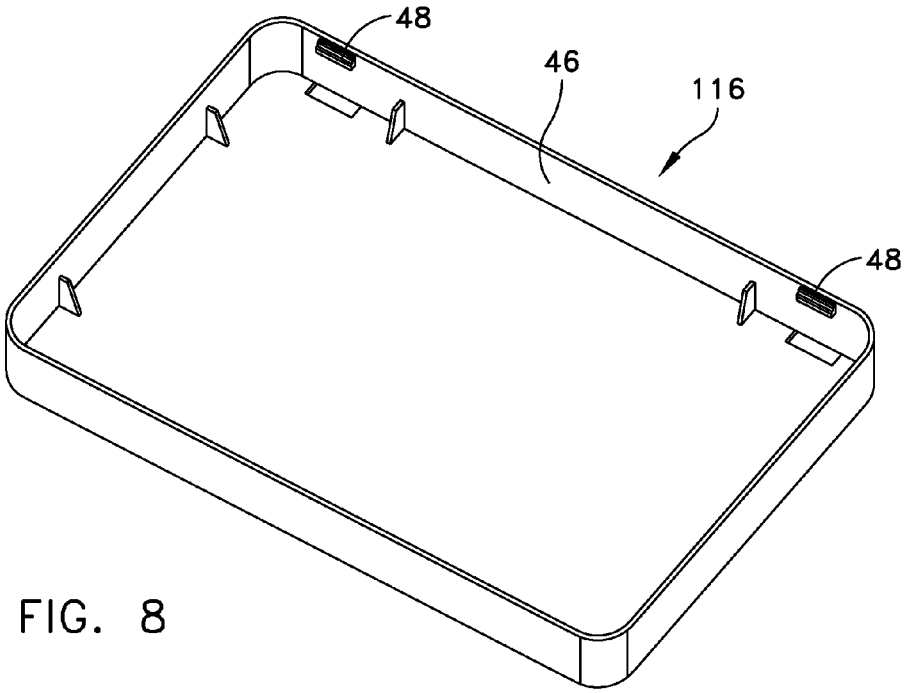
FIG. 8 is a bottom perspective view of the cover of FIG. 7.
Figure 9:
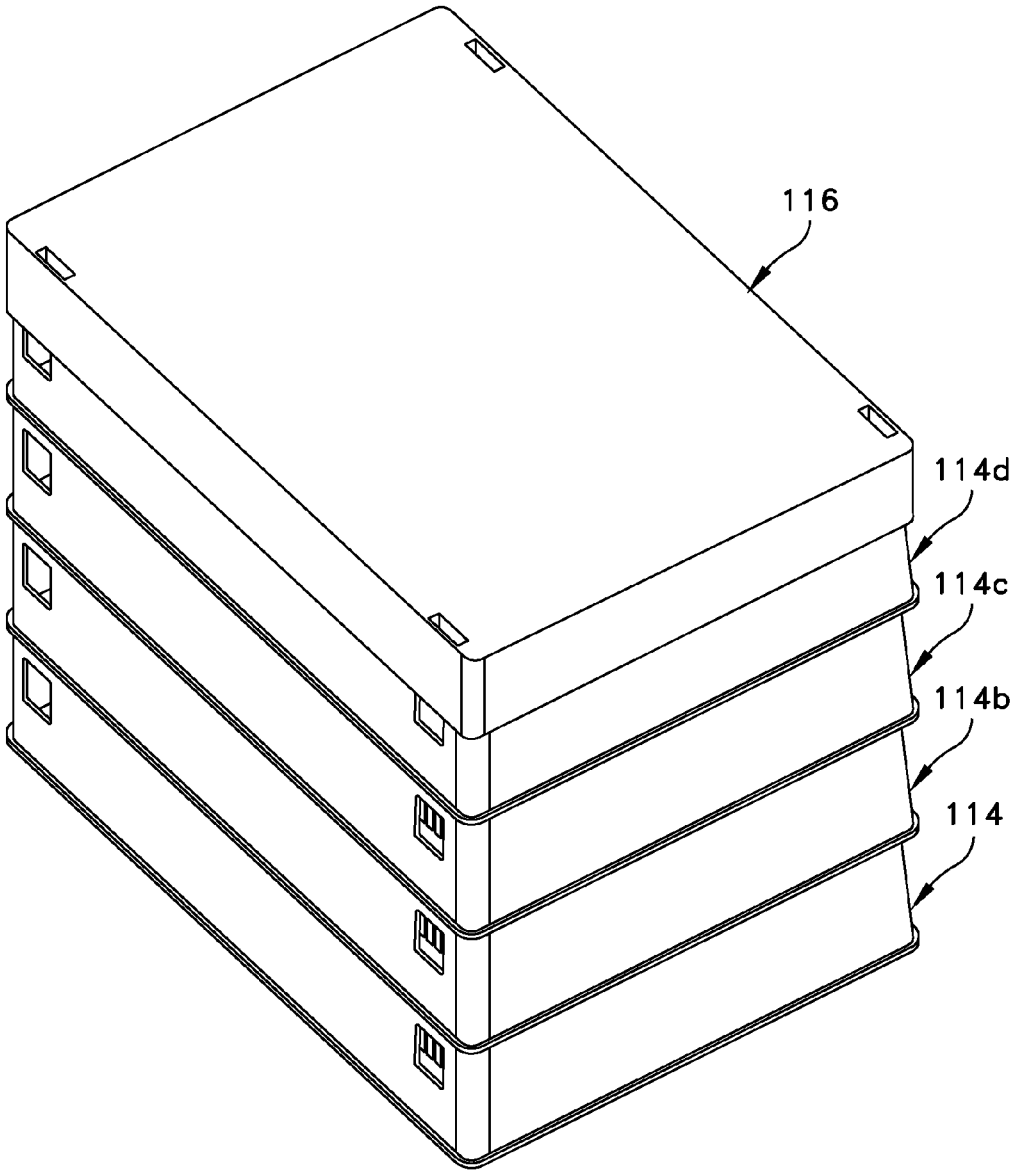
FIG. 9 is a perspective view of the packaging device tray of FIG. 4 illustrating multiple trays stacked.
Figure 10:
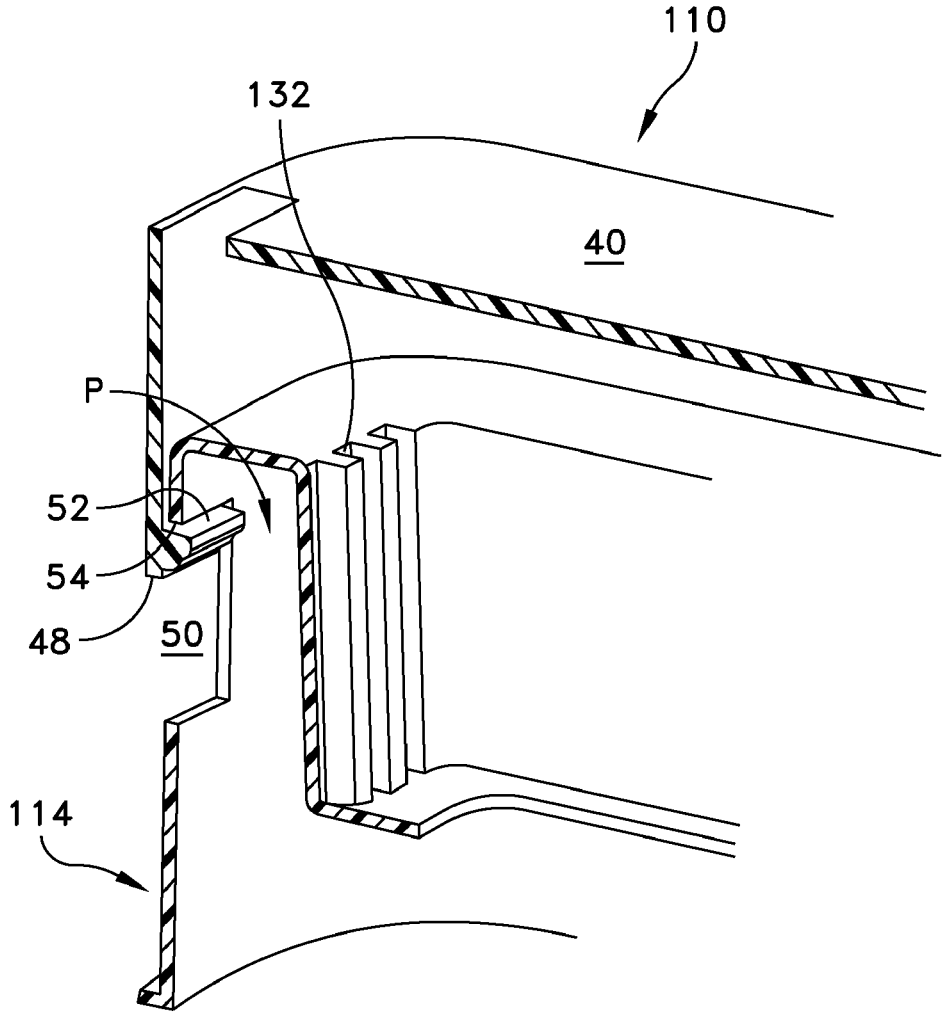
FIG. 10 is an enlarged view illustrating the cover of FIGS. 7 and 8 in engagement with the tray of FIG. 4.

Referring now to FIGS. 4-10, a second embodiment of the packaging device including cover 16 is illustrated. In this embodiment, the same or similar components as FIGS. 1-3 are labeled with the same reference numbers, preceded with the numeral "1". As shown in the figures, the cover is sized and shaped to fit over tray 114 to secure the cards within the tray, for example during transportation. Thus, in the present embodiment, the cover has a generally rectangular shape. As shown in FIG. 7, the cover includes a top 40, sidewalls 44*a, b* and ends walls 44*c, d* extending from the top, and may also include locking tabs 48 supported on an inner surface 46 of the sidewalls 44*a, b*. If locking tabs 48 are provided on the cover 116, corresponding openings 50 are provided within sidewalls 120*a*, 120*b* of the tray 114. As best illustrated in FIG. 10, the openings 50 are configured and dimensioned to receive the locking tabs 48 therein in a snap-fit arrangement so that upon placing the cover 116 onto the tray 114, the tabs 48 snap into the openings 50. After insertion within the openings, an inner surface 52 of the tabs abut an upper surface 54 bounding the opening 50. The tabs 48 remain positioned within the openings 50 until a user applies pressure to the tabs (see arrow "P") to force the tabs from engagement within their corresponding openings. Alternatively, the reverse combination may be utilized, i.e. the cover may have the openings and the trays may include the locking tabs, or no locking tabs and openings may be provided. Alignment openings 52 disposed in the top 40 and dimensioned to receive alignment tabs 54 supported by the top surface 138 of the tray 114 to aid in proper placement of the cover onto the tray may also be provided. Alternatively, the reverse combination may be utilized, i.e. the tray may have the openings and the cover may include the alignment tabs, or no tabs and openings may be provided. The alignment tabs and openings aid in the proper positioning of the cover onto the tray.

In addition to providing a cover for the tray 114, the trays may be sized so that stacking of multiple trays is possible, with the stacked trays acting as a cover for the adjacent trays underneath and a cover being used only on the uppermost tray. As shown in FIG. 9, additional trays 114*b*-114*d* are provided in a stacked arrangement, each tray covering the base underneath. In order to stack the trays, a channel 56 is provided along the perimeter of the tray, on the underside, as illustrated in FIG. 6. In use, the sidewalls and end walls of the lower tray are seated within the channel 56 of the adjacent, upper tray. For example, the sidewalls and end walls of tray 114 are seated within the channel of tray 114*b*, and the sidewalls and end walls of tray 114*b* are seated within the channel of tray 114*c* etc., until the uppermost tray 114*d* is reached. Cover 116 caps the uppermost tray 114*d*, as described herein. Use of the packaging device will now be described with reference to FIGS. 1-10.

In use, the cards 112 are inserted within slots 122 of the tray 114 such that the outer border of each of the cards is at least partially disposed within one of the sets of slots 122, and so that the buttons 113 of each of the cards is disposed exterior to the set of slots, and within one of the first 124 and second 126 channels. The display window may either be positioned above the top surface of the tray, or within one of the first and second channels, depending upon the depth of the tray. After the cards are properly inserted within the tray, a cover may be positioned over the tray. If alignment openings and tabs are provided, the alignment openings 52 are aligned over the alignment tabs 54 and the cover is then lowered onto the tray and the alignment tabs 54 are inserted within the alignment openings 52. If locking tabs 48 are also provided, pressure is applied to the cover until the locking tabs 48 are inserted within the corresponding openings 50 and the tabs are received within the openings. Once securely placed, the cover may remain in position until a user removes it by disengaging the locking tabs 48 from openings 50 as described hereinabove.

Figure 13:
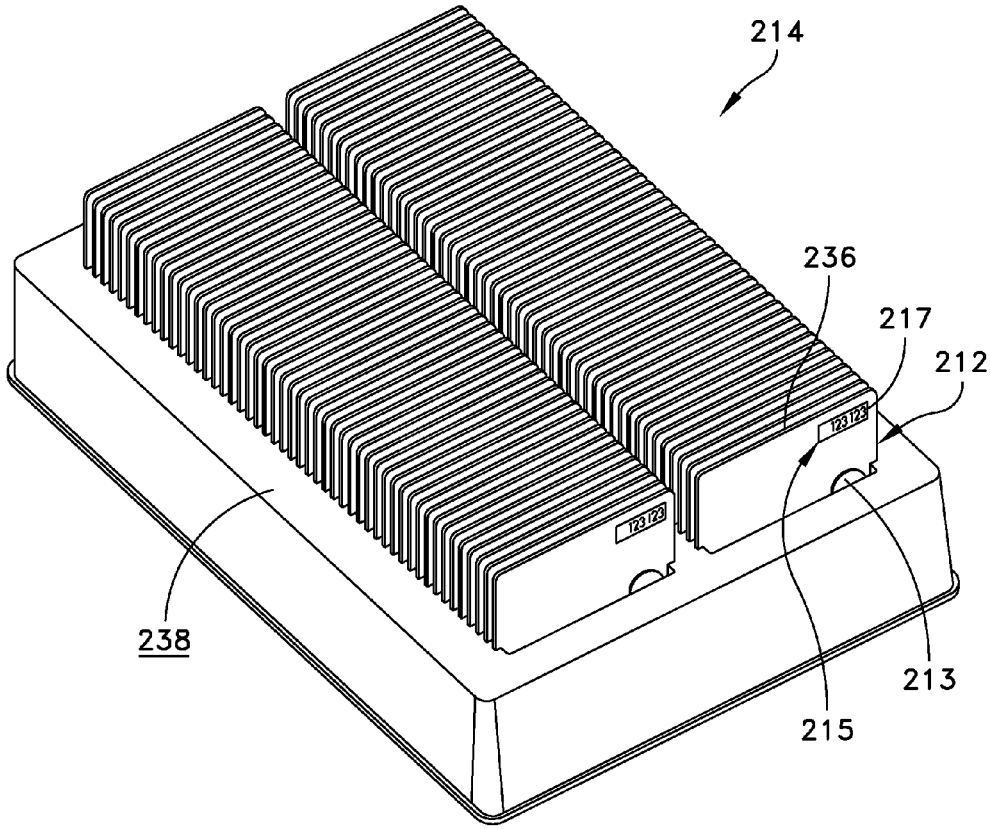
FIG. 13 is a perspective view of the device of FIG. 11 with a plurality of authentication tokens supported in the device.
Figure 15:
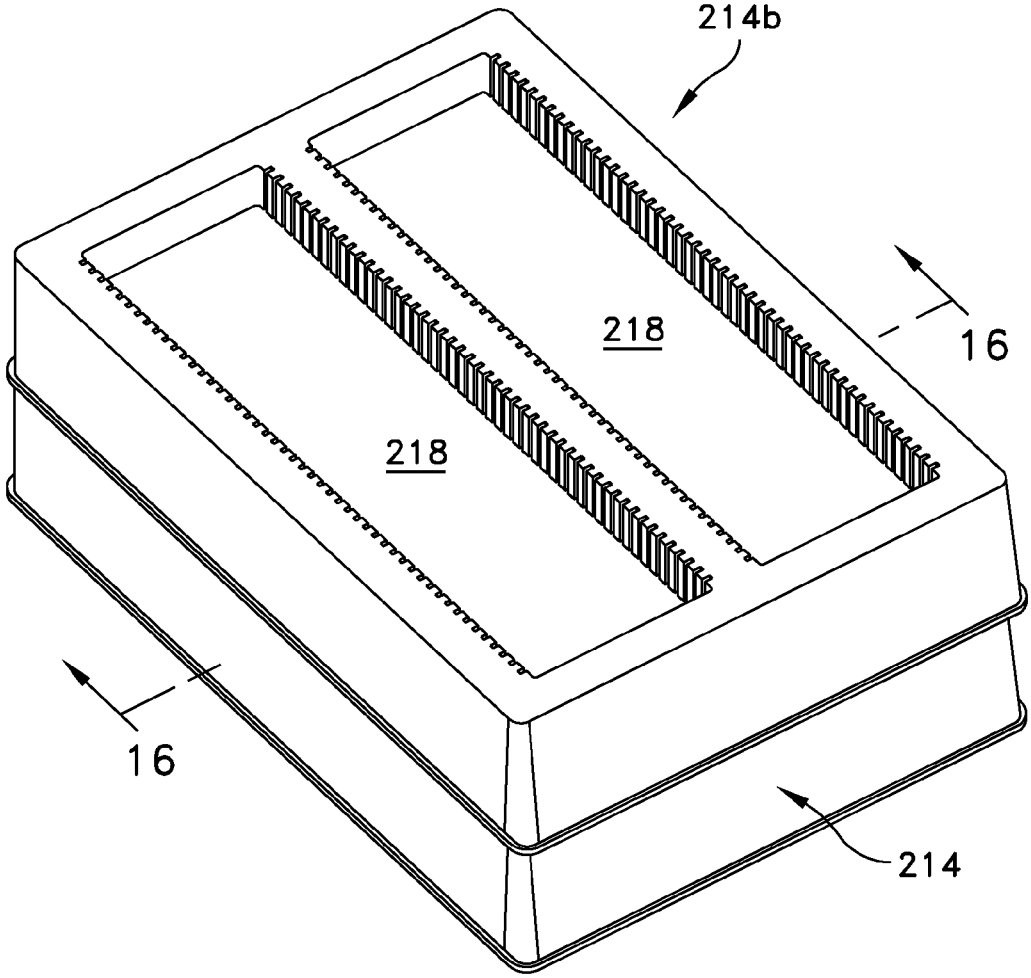
FIG. 15 is a perspective view of an empty tray stacked and acting as a cover for the tray of FIG. 11.
Figure 16:
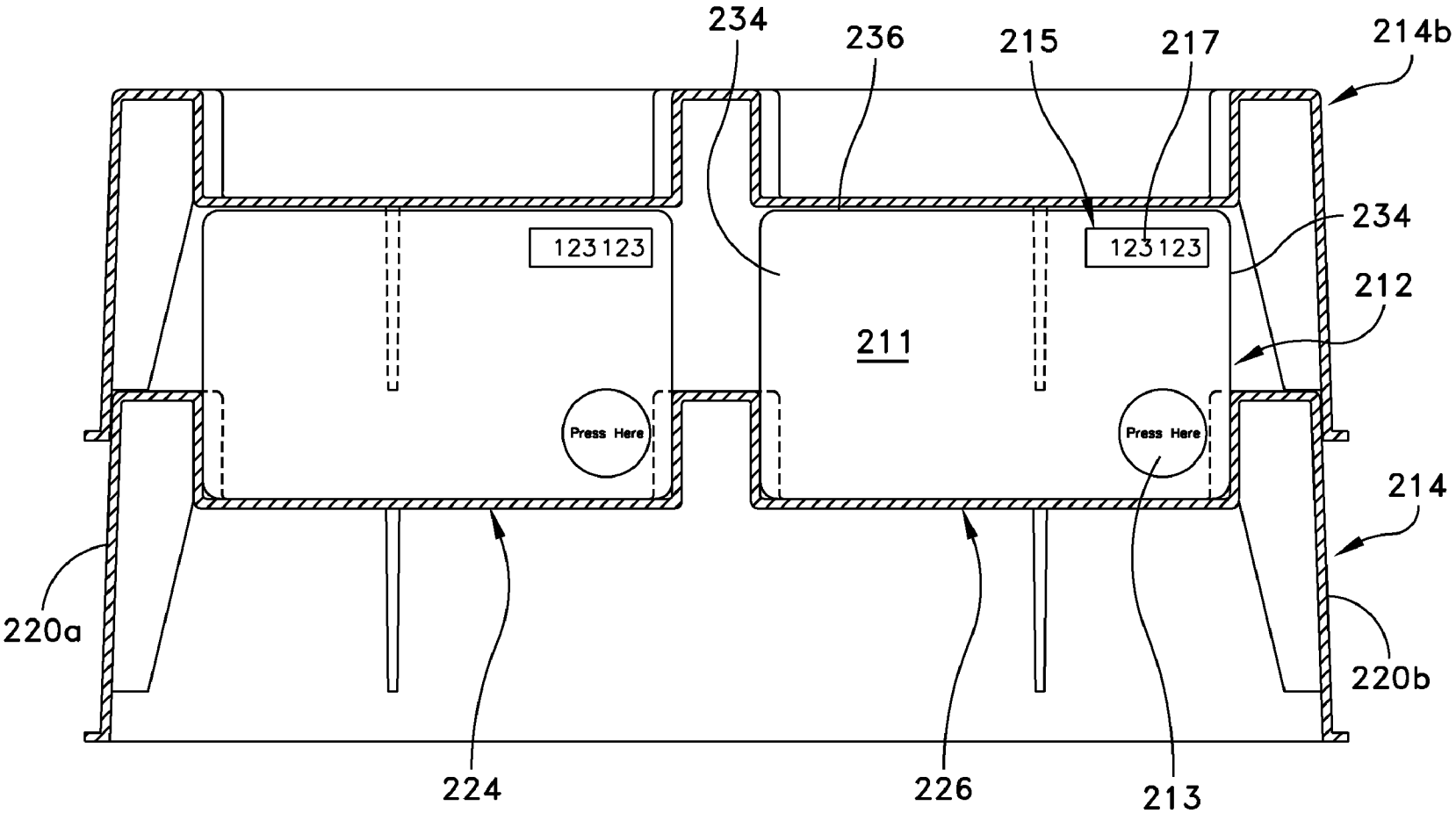
FIG. 16 is a cross sectional view taken along lines 16-16 of FIG. 15.

Referring now to FIGS. 11-16, a third embodiment of the packaging device 10 is illustrated. In this embodiment, the same or similar components as the previous figures are labeled with the same reference numbers, preceded with the numeral "2". The tray of FIG. 11 is the same in all respects as the tray of FIG. 1, except that the depth of the tray, "b" is shallower than that of the previous figures and the base 218 of the tray has a continuous surface, i.e. there are no openings through the base. The shallower base supports the cards 212 so that the top edge 236 of the cards is above the top surface 238 of the tray 214, as best shown in FIGS. 13-14. The tray 214 is otherwise as described with respect to FIG. 1, as described above. As shown in FIGS. 14-16, the trays 214 are stackable as described above, but do not include locking tabs and openings.

While various embodiments of the invention have been particularly shown and described, it will be understood by those skilled in the art that various changes in form and details may be made therein without departing from the spirit and scope of the invention as defined by the appended claims.

For example, the dimensions and geometric shapes disclosed herein may be modified, as would be known to those of skill in the art. Likewise, the drawings provided are not to be construed as limiting, but as exemplary embodiments.

What is claimed is:

1. A packaging device for housing a set of authentication tokens, each authentication token from the set of authentication tokens including an activation member, the packaging device comprising:

a first tray including:

a base;

a first sidewall coupled to the base;

a second sidewall coupled to the base;

a pair of endwalls;

a stacking channel provided along a perimeter of an underside of the first tray; and a plurality of engagement members supported by at least one of the first sidewall and the second sidewall, each engagement member from the plurality of engagement members being constructed and arranged to support an authentication token within the first tray; and at least one additional tray, each additional tray including:

a base;

a first sidewall coupled to the base;

a second sidewall coupled to the base;

a pair of endwalls;

a stacking channel provided along a perimeter of an underside of that tray; and a plurality of engagement members supported by the first sidewall and the second sidewall, each engagement member being constructed and arranged to support an authentication token within that tray;

wherein each engagement member from the plurality of engagement members of the first tray is further constructed and arranged to support an authentication token along an outer border of the authentication token disposed between a perimeter of the activation member and an outer edge of the authentication token to prevent the engagement member from contacting the activation member;

wherein each engagement member of the plurality of engagement members of each additional tray is further constructed and arranged to support an authentication token along an outer border of the authentication token disposed between a perimeter of the activation member and an outer edge of the authentication token to prevent the engagement member from contacting the activation member; and wherein the sidewalls and endwalls in each of the first and at least one additional trays are constructed and arranged to be seated within the stacking channel of another tray above the tray to provide a stacking arrangement.

2. The packaging device of claim 1, wherein the first tray further includes at least one interior wall disposed between the first sidewall and the second sidewall, and wherein the plurality of engagement members of the first tray are additionally supported by the at least one interior wall.

3. The packaging device of claim 2, wherein the plurality of engagement members of the first tray comprises a first set of slots disposed on an inner surface of each of the first sidewall and the second sidewall and a second set of slots disposed on outer surfaces of the at least one interior wall, and wherein the first set of slots correspond in number and location to the second set of slots, each slot from the first set of slots and adjacent slot from the second set of slots together forming a pair, each pair of slots forming a single card engagement member.

4. The packaging device of claim 3, further comprising a first channel disposed between the first sidewall and the at least one interior wall and a second channel disposed between the second sidewall and the at least one interior wall.

5. The packaging device of claim 4, wherein the outer border of each authentication token is at least partially disposed within a set of slots chosen from a group which includes the first set of slots and the second set of slots, and wherein the activation member of the authentication token is disposed exterior to the set of slots and within one of the first and second channels.

6. The packaging device of claim 1, wherein the activation member of each authentication token comprises a button.

7. The packaging device of claim 1, further comprising a cover.

8. The packaging device of claim 7, wherein one of the cover and the first tray includes a locking member.

9. The packaging device of claim 8, wherein the locking member includes a locking tab supported on an inside surface of the cover and a locking opening disposed in the first tray, the locking tab and locking opening engaging during use to secure the cover to the first tray.

10. The packaging device of claim 7, wherein one of the cover and the first tray includes alignment tabs and the other of the cover and tray includes alignment openings, the alignment tabs and alignment openings together being configured and dimensioned to align the cover with the first tray.

11. The packaging device of claim 4, wherein the at least one interior wall is a pair of interior walls defining an interior channel there between and further including a third set of slots supported by the interior walls adjacent the interior channel.

12. In combination:

a packaging device comprising:

a first tray including:

a base;

at least a first and a second sidewall;

a pair of endwalls;

a stacking channel provided along a perimeter of an underside of the first tray; and a plurality of engagement members supported by at least one of the first and second sidewalls, each engagement member being constructed and arranged to engage each token to support the token within the first tray; and at least one additional tray, each additional tray including:

a base;

a first sidewall coupled to the base;

a second sidewall coupled to the base;

a pair of endwalls;

a stacking channel provided along a perimeter of an underside of that tray; and a plurality of engagement members supported by the first sidewall and the second sidewall, each engagement member being constructed and arranged to engage each token to support the token within that tray;

a token comprising:

a token body including an outer edge and top edge, and a face;

an activation member supported on the token body and constructed and arranged to be activated by a user to trigger the production of a one time passcode;

a display window supported on the token body and constructed and arranged to display the one time passcode to the user;

an outer border disposed between a perimeter of the activation member and the outer edge of the token; and wherein the engagement members of the plurality of engagement members of the first tray each supports one authentication token at the outer border of the token so that the activation member and display window are spaced from the engagement member;

wherein the engagement members of the plurality of engagement members of each additional tray each supports one authentication token at the outer border of the authentication token so that the activation member and display window are spaced from the engagement member; and wherein the sidewalls and endwalls in each of the first and at least one additional trays are constructed and arranged to be seated within the stacking channel of another tray above the tray to provide a stacking arrangement.

13. The combination of claim 12, wherein the first tray further includes at least one interior wall disposed between the first sidewall and the second sidewall, and wherein the plurality of engagement members of the first tray are supported by at least one of the first and second sidewalls and the at least one interior wall.

14. The combination of claim 13, wherein the plurality of engagement members comprises of the first tray a first set of slots disposed on an inner surface of both the first and second sidewalls and a second set of slots disposed on the outer surfaces of the interior wall, and wherein the slots disposed in the inner surface of the first and second sidewalls correspond in number and location to the slots disposed in the outer surface of the adjacent interior wall, each sidewall slot and adjacent slot together forming a pair, each pair of slots forming a single card engagement member.

15. The combination of claim 14, further comprising a first channel disposed between the first sidewall and the at least one interior wall and a second channel disposed between the second sidewall and the at least one interior wall.

16. The combination of claim 15, wherein the outer border of each of the tokens is at least partially disposed within one of the sets of slots and wherein the activation member of the token is disposed exterior to the set of slots and within one of the first and second channels.

17. The combination of claim 12, wherein the activation member comprises a button.

18. The combination of claim 12, further comprising a cover.

19. The combination of claim 18, wherein one of the cover and the tray includes a locking member.

20. The combination of claim 19, wherein the locking member includes a locking tab supported on an inside surface of the cover and a locking opening disposed in the tray, the locking tab and locking opening engaging during use to secure the cover to the tray.

21. The combination of claim 18, wherein one of the cover and the tray includes alignment tabs and the other of the cover and tray includes alignment openings, the alignment tabs and alignment openings together being configured and dimensioned to align the cover with the tray.

22. The combination of claim 14, wherein the at least one interior wall is a pair of interior walls defining an interior channel there between and further including a third set of slots supported by the interior walls adjacent the interior channel.

23. A packaging device for housing a set of authentication tokens, each authentication token from the set of authentication tokens having an activation button, the packaging device comprising:

a first tray including:

a base;

a first sidewall having an inner surface and coupled to the base;

a second sidewall having an inner surface and coupled to the base;

at least one interior wall disposed between the first sidewall and the second sidewall and including a pair of outer surfaces; and a plurality of slots disposed in the inner surface of the first sidewall, the inner surface of the second sidewall and the outer surfaces of the interior wall, wherein slots disposed in the inner surface of the first sidewall and second sidewall correspond in number to the slots disposed in each outer surface of an adjacent interior wall, each sidewall slot and adjacent interior wall slot together forming a pair, the tray being constructed and arranged to support an authentication token between each pair of slots; and a cover;

a pair of endwalls; and a stacking channel provided along a perimeter of an underside of the first tray; and at least one additional tray, each additional tray including:

a base;

a first sidewall having an inner surface and coupled to the base;

a second sidewall having an inner surface and coupled to the base;

at least one interior wall disposed between the first sidewall and the second sidewall and including a pair of outer surfaces; and a plurality of slots disposed in the inner surface of the first sidewall, the inner surface of the second sidewall and the outer surfaces of the interior wall, wherein slots disposed in the inner surface of the first sidewall and second sidewall correspond in number to the slots disposed in each outer surface of an adjacent interior wall, each sidewall slot and adjacent interior wall slot together forming a pair, that tray being constructed and arranged to support an authentication token between each pair of slots;

a cover;

a pair of endwalls; and a stacking channel provided along a perimeter of an underside of that tray;

wherein the first tray supports the authentication token between each pair of slots along an outer border of the authentication token disposed between a perimeter of the button and an outer edge of the authentication token;

wherein each additional tray supports the authentication token between each pair of slots along an outer border of the authentication token disposed between a perimeter of the button and an outer edge of the authentication token;

wherein the sidewalls and endwalls in each of the first and at least one additional trays are constructed and arranged to be seated within the stacking channel of another tray above the tray to provide a stacking arrangement.

* * * * *